US009790071B2

(12) United States Patent
Lemper

(10) Patent No.: US 9,790,071 B2
(45) Date of Patent: Oct. 17, 2017

(54) DEVICE FOR EXTRACTING A CORK FROM A BOTTLE

(71) Applicant: Brian Lemper, Las Vegas, NV (US)

(72) Inventor: Brian Lemper, Las Vegas, NV (US)

( * ) Notice: Subject to any disclaimer, the term of this patent is extended or adjusted under 35 U.S.C. 154(b) by 251 days.

(21) Appl. No.: 14/828,906

(22) Filed: Aug. 18, 2015

(65) Prior Publication Data

US 2016/0052763 A1 Feb. 25, 2016

Related U.S. Application Data

(60) Provisional application No. 62/039,176, filed on Aug. 19, 2014.

(51) Int. Cl.
*B67B 7/08* (2006.01)
*B67B 7/04* (2006.01)

(52) U.S. Cl.
CPC ..... *B67B 7/08* (2013.01)

(58) Field of Classification Search
CPC ..... B67B 7/00; B67B 7/04; B67B 7/08
See application file for complete search history.

(56) References Cited

U.S. PATENT DOCUMENTS

| | | | | |
|---|---|---|---|---|
| 4,791,834 | A | 12/1988 | Federighi | |
| 6,223,626 | B1 | 5/2001 | West | |
| 7,032,364 | B2 * | 4/2006 | Yoshida | B65D 39/0052 53/403 |
| 7,231,850 | B2 | 6/2007 | Wang | |

* cited by examiner

*Primary Examiner* — David B Thomas
(74) *Attorney, Agent, or Firm* — Vincent G. LoTempio; Kloss, Stenger & LoTempio; David T. Stephenson

(57) ABSTRACT

A device for extracting a cork from a bottle. The device leverages an axial and rotational pulling force, and pressurized gas in the interior of the bottle to displace a cork from a bottle. The device provides a helical-shaped lever that axially and rotatably penetrates through the cork to forcibly extract the cork from the bottle neck. The helical-shaped lever has a hollow passageway that is in communication with the interior volume of the bottle. The device further includes a gas cartridge operated by a pressure release button that discharges pressurized gas through the hollow passageway of the helical-shaped lever, and into the bottle. The moment at which helical-shaped lever fully penetrates the cork, tension is removed from helical-shaped lever, releasing a compressed spring to expand. Expansion of spring presses spring against pressure release button; thereby forming tactile feedback and indicating optimal moment to discharge pressurized gas.

20 Claims, 8 Drawing Sheets

DEVICE FOR EXTRACTING A CORK FROM A BOTTLE

CROSS REFERENCE OF RELATED APPLICATIONS

This application claims the benefits of U.S. provisional application No. 62/039,176 filed on Aug. 19, 2014 and entitled DEVICE FOR EXTRACTING A CORK FROM A BOTTLE, which provisional application is incorporated by reference herein in its entirety.

FIELD OF THE INVENTION

The present invention relates generally to a device for extracting a cork from a bottle. More so, a device for extracting a cork from a bottle provides a helical-shaped lever that penetrates into a cork for pulling the cork out of a bottle neck, and a gas cartridge that discharges pressurized gas into the interior volume of the bottle as the helical-shaped lever penetrates the cork; whereby the helical-shaped lever exerts an axial and rotational pulling force on the cork, and the gas cartridge discharges the pressurized gas into the interior volume of the bottle to forcibly displace the cork out of the bottle neck.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known that corks are traditionally used to close and seal wine bottles or the like. Use of a conventional corkscrew to extract the cork from the bottle subjects consumers of wine to a variety of problems. Substantial physical effort and dexterity on the part of the user of the corkscrew is required. A corkscrew sometimes creates a disruption in the cork, which allows the corkscrew to withdraw from the bottle without withdrawing the cork itself from the bottle, or causing the cork to splinter with remnants of the cork falling into the wine or liquid in the bottle.

Several devices have been invented to facilitate extracting corks from wine bottles or similar containers using pressurized fluid or air pressure to compel the cork out of the bottle. For example U.S. Pat. No. 4,791,834 issued to Federighi, discloses a device for extracting corks from a wine bottle or the like including a body and pressurized fluid container, a hollow needle extending from the body for penetration through the cork and annular one-way valve mechanism for selectively injecting pressurized fluid into the wine bottle through the needle to generate gas pressure which ejects the cork from the bottle. However, the '834 patent does not disclose an extraction device with an air pump. Additionally, the '834 patent does not disclose air pressure as a means to extract a cork from a bottle.

U.S. Pat. No. 6,223,626 issued to West, discloses a cork removal device for injecting air between the contents of a bottle to compel the cork out of the bottle. The '626 patent discloses a base portion and cap, with the base portion having a bottom wall. A needle for inserting into corks has a blunt end and a sharp end. The '626 patent further discloses an annular one-way valve located in the lumen of the needle. The annular one-way valve is adapted to allow airflow through the lumen, in one direction. To engage the device a cap is pressed into the interior of the base portion forcing air from the interior of the base portion through the needle and into the bottle between the cork and the contents of the bottle. The air forced into the bottle compels the cork out of the bottle. The '626 patent does not disclose a lever or rod member attached to the device. Furthermore, the '626 does not disclose a piston and spring method for extracting a cork from a bottle.

U.S. Pat. No. 7,231,850 issued to Wang, discloses a manual wine bottle opener including a main body, a fixing base, a piston rod, a press lever, an annular one-way valve base, a sleeve and a slide member combined together. By reciprocally pulling and pressing the press lever for moving the piston up and down repeatedly, air can be pumped into the wine bottle through the insert needle for removing the cork of the wine bottle from the bottle mouth. However, the '850 patent does not disclose a trigger mechanism for one-handed operation and extraction of a cork from a bottle.

Other proposals have involved devices to remove corks from wine bottles. The problem with these is that they damage the cork and are difficult to operate, especially for corks that are snugly fit in the neck of the bottle. Even though the above cited gripping devices meets some of the needs of the market, a device for extracting a cork from a bottle through both an axial and rotational pulling force, and a pressurized gas that is discharged in the interior of the bottle to displace the cork from a bottle without damaging the cork or exerting excessive efforts is still desired.

SUMMARY OF THE INVENTION

The present invention is directed to a device for extracting a cork from a bottle. The device leverages an axial and rotational pulling force, and pressurized gas in the interior of the bottle to displace the cork from a neck of the bottle. The device provides a helical-shaped lever that penetrates the cork. The helical-shaped lever may include a corkscrew that axially and rotatably penetrates through the cork, and uses the cork as a fulcrum to forcibly extract the cork from the bottle neck. The helical-shaped lever has a hollow passageway that is in communication with the interior volume of the bottle.

The device further includes a gas cartridge that contains a pressurized gas. The gas cartridge may be manually actuated through a pressure release button to variably discharge pressurized gas through the hollow passageway of the helical-shaped lever, and into the interior volume of the bottle. This creates gas pressure inside the bottle, which facilitates removal of the cork. The simultaneous use of both axial and rotational pulling force, and pressurized gas not only reduces physical exertion needed to remove the cork, but also reduces damage and fragmentation to the cork.

The device utilizes a spring that provides tactile feedback against the pressure release button when the helical-shaped lever has fully penetrated the cork. The moment at which the helical-shaped lever has penetrated the cork pressure on the helical-shaped lever is relieved, and the compacted spring expands. As the spring expands, it presses against the pressure release button. Expansion of the spring displaces the pressure release button, and thereby provides tactile feedback indicating the cork has been penetrated.

Upon feeling tactile feedback, a user may manipulate the pressure release button to variably discharge the pressurized gas from the gas cartridge. The tactile feedback helps synchronize penetration of the cork by the helical-shaped lever, with the discharge of pressurized gas, so as to optimize effectiveness of the device when removing the cork. Thus, the device exerts an axial and rotational pulling force through manipulation of the helical-shaped lever that is synchronized with a variably controlled discharge of pressurized gas into the interior volume of the bottle to forcibly extract the cork from the bottle neck without damaging the cork.

In some embodiments, the device may include a handle having a generally T-shape. The handle provides a gripping surface to manipulate the helical-shaped lever. The handle mounts on a housing having an upper end and a lower end. The device further includes a shaft, which threadably engages the lower end of the housing. The shaft is defined by a cavity, an air intake, and an air exhausting hole.

The device may further include a hollow, helical-shaped lever that fixedly attaches to the shaft. The helical-shaped lever is defined by a hollow passageway and a pointed end having an opening. The helical-shaped lever is configured to grip and penetrate the cork longitudinally, and for axial and rotational manipulation of the cork. The hollow nature of the helical-shaped lever provides a pathway for pressurized gas to reach the interior volume of the bottle.

The device also includes a gas cartridge for containing and discharging a pressurized gas into the interior volume of the bottle. The gas cartridge threadably engages a release valve mechanism. The release valve mechanism regulates discharge of the pressurized gas from the gas cartridge. A pressure release button operatively connects to the release valve mechanism for releasing the pressurized gas. Manipulating the pressure release button serves to discharge pressurized gas from the gas cartridge. The pressurized gas passes through the air exhausting hole of the shaft, through the helical-shaped lever, and through the channel that is formed through the cork, before finally filling the interior volume of the bottle.

The pressure release button senses when the helical-shaped lever has penetrated the cork through a spring that is disposed across the length of the shaft. The pressure release button operatively connects to the spring in the release valve mechanism, so as to provide tactile feedback when the spring expands. The moment at which the helical-shaped lever has fully penetrated the cork, tension is removed from helical-shaped lever, thereby causing spring to expand. Expansion of spring works to abut spring against pressure release button. This provides a tactile indication for when the pressurized gas should be released into the bottle.

The pressurized gas allows for variable pressurization in the interior volume of the bottle. This prevents cork tearing or fragmentation by an assisted pushing force for selectively pushing pressurized gas through the shaft, and into the bottle between the cork and the contents of the bottle. In this manner, the pressurized gas that is discharged into the interior volume of the bottle forces the cork out of the bottle in conjunction with axial and rotational force applied by pulling the T-shaped handle to remove the cork.

It is one objective of the present invention to provide a helical-shaped lever that anchors into the cork, rotatably penetrates through the cork, and uses the cork as a fulcrum to forcibly extract the cork from the bottle neck Yet another object of the invention is to provide a gas cartridge, which discharges pressurized gas through the formed channel to create air pressure between the cork and contents of the bottle, thereby ejecting the cork out of the bottle.

Yet another object of the invention is to provide a pressure release button that operatively connects to the release valve mechanism to actuate discharge of the pressurized gas into the interior volume of the bottle and create air pressure to compel the cork out of the bottle with very little risk of damaging the cork.

Yet another object of the invention is to provide tactile feedback on the pressure release button that indicates when the helical-shaped lever has penetrated the cork, so as to enable the pressure release button to be actuated for discharging the pressurized gas through the channel and into the interior volume of the bottle.

Another further object of the invention is to provide an improvement to the conventional helical-shaped lever through the addition of a hollow helical-shaped lever which allows for variable pressurization of the internal volume of the bottle, creating air pressure to extract a cork from a bottle with minimal physical effort by the user.

Another further object of the invention is to simultaneously use both axial and rotational pulling force, and pressurized gas to reduce physical exertion needed to remove the cork, and also reduce damage and fragmentation to the cork.

Another further object of the invention is to provide an inexpensive to manufacture device for extracting a cork form a bottle.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
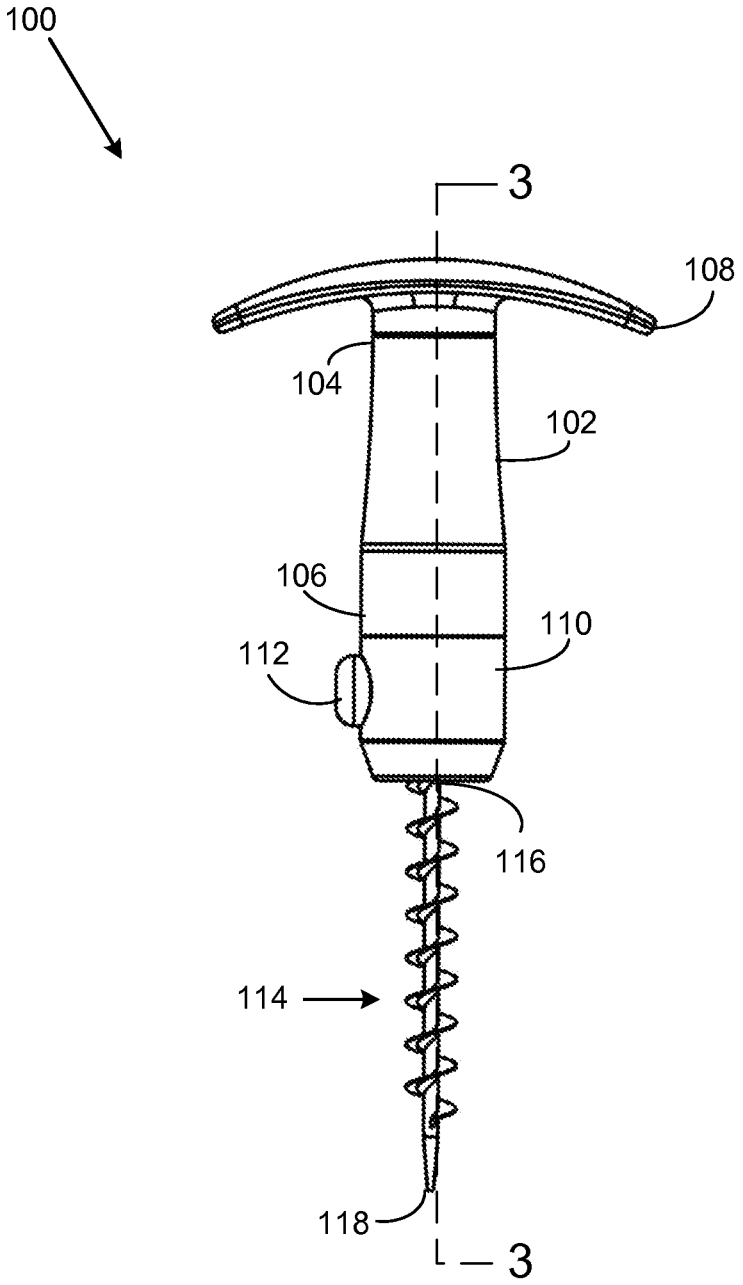
FIG. 1 is a side view of a device for extracting a cork from a bottle with a hollow helical-shaped lever with a pointed end.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

FIGS. 1-8 illustrate a device 100 for extracting a cork from a bottle. The device 100 is configured to combine an axial and rotational pulling force, and a pressurized gas to forcibly displace the cork from a bottle (not shown). The simultaneous use of both axial and rotational pulling force, and pressurized gas not only reduces physical exertion needed to remove the cork, but also reduces damage and fragmentation to the cork. In one possible embodiment, the bottle may include, without limitation, a wine bottle, a champagne bottle, a seltzer bottle, a bottle of pressurized air, and a plumbing pipe. The cork may include a wooden cork known in the art of wine bottles. Though, the device 100 may be utilized with any number of fluid blocking members, including, without limitation, a rubber cork, a plumbing pipe barrier, a stoppage for a bottle of chemicals, and an air duct barrier.

In one possible embodiment, device 100 provides a helical-shaped lever 114 that axially and rotatably penetrates the cork and uses the cork as a fulcrum to forcibly extract the cork from the neck of the bottle. Helical-shaped lever 114 is defined by a hollow passageway that enables passage of a pressurized gas into the interior volume of the bottle.

The device 100 further includes a gas cartridge 120 that contains the pressurized gas. A pressure release button 112 variably discharges the pressurized gas from gas cartridge 120. Pressure release button 112 enables pressurized gas to be variably released through the hollow passageway of the helical-shaped lever 114, and into the interior volume of the bottle. This results in gas pressure buildup between the contents of the bottle and the cork; thereby helping to force the cork out of the neck of the bottle.

In one exemplary embodiment, the moment at which the helical-shaped lever 114 has fully penetrated the cork, a spring 122 is triggered to expand. The spring is disposed, such that it expands to press against pressure release button 112. This creates a tactile feedback at pressure release button 112 that indicates the optimal moment when the pressurized gas should be discharged into the interior volume of the bottle. Thus, the device 100 exerts an axial and rotational pulling force through manipulation of the helical-shaped lever 114 that is synchronized with a variably controlled discharge of pressurized gas into the interior volume of the bottle to forcibly extract the cork from the bottle neck without damaging the cork.

Adverting now to the drawings, with reference to FIG. 1, a preferred embodiment of the present disclosure, a device 100 for extracting a cork from a bottle. The device 100 may include a housing 102 having an upper end 104 and a lower end 106. Housing 102 is generally tubular and cylindrical. Housing 102 acts as a chamber for containing and supporting a shaft 110, a gas cartridge 120, a release valve mechanism 124, and a spring 122. Device 100 further includes a handle 108 having a generally T-shape. Housing 102 marries to handle 108. In one embodiment, handle 108 and housing 102 are sealed at the left and right ends by end caps.

Handle 108 is configured for axial rotation of a helical-shaped lever 114 to penetrate, grip, and forcibly extract the cork from the neck of a bottle. Those skilled in the art, in light of the present teachings, will recognize that conventional helical-shaped levers, such as corkscrews, require the user to exert physical effort, and often require the user twist their hand or the wine bottle in an awkward position. This twisting and pulling often results in damage to the cork, with pieces of the cork falling into the wine or liquid contained in the bottle. Much like a wine bottle corkscrew, the device 100 is compact and made to fit into the hand of a user and thus configured as a conventional handle 108 to pull cork from a bottle.

Device 100 further includes a shaft 110. Shaft 110 orients along the longitudinal axis of housing 102. In one embodiment, shaft 110 has a smaller circumference than housing 102, and rests inside housing 102. Shaft 110 threadably engages lower end 106 of housing 102 to detachably attach thereto. In one embodiment, shaft 110 is hollow and generally tubular in shape.

Shaft 110 is defined by a cavity 126, an air intake 128, and an air exhausting hole 130. Cavity 126, air intake 128, and air exhausting hole 130 are in communication. Air exhausting hole 130 is located above the terminus of shaft 110. Air exhausting hole 130 may provide an opening that enables passage of pressurized gas directly into the interior volume of the bottle. It should be appreciated that the position of air intake 128 and air exhausting hole 130 cannot be on the termini of shaft 110, but can be located at any position of the distal centimeter of shaft 110.

Device 100 further includes a helical-shaped lever 114, such as a corkscrew. Helical-shaped lever 114 is defined by a hollow passageway, a mount end 116, and a pointed end 118 having an opening. The mount end 116 of helical-shaped lever 114 fixedly attaches to the lower terminus of shaft 110. In one embodiment, mount end 116 includes a threaded base that rotatably engages a threaded terminus of shaft 110.

Pointed end 118 of helical-shaped lever 114 is configured to grip and penetrate the cork longitudinally. Helical-shaped lever 114 is also configured for axial and rotational manipulation of the cork. In operational use, helical-shaped lever 114 is operatively arranged to be axially driven through the cork with an axial rotation to facilitate penetration.

In one possible embodiment, helical-shaped lever 114 is a 3" corkscrew having a pointed end 118 with an opening. The helical-shaped lever 114 is long enough to extend through a standard wine bottle cork, and through at least a portion of the neck of the bottle. The present embodiment of the helical-shaped lever 114 may be tipped with a pointed end 118 that is configured to pierce the surface of the cork upon insertion into the cork. Upon penetration of the cork, the air exhausting hole 130 of the shaft 110 passes through the cork and enters into the interior volume of the bottle.

In one possible embodiment, helical-shaped lever 114 may include a linear rod having a spiraling helical member running along the length of linear rod. Suitable materials for helical-shaped lever 114 may include, without limitation, steel, metal alloys, a rigid polymer, and wood.

In some embodiments, helical-shaped lever 114 is not solid throughout like a conventional helical-shaped lever 114. When helical-shaped lever 114 penetrates the cork, the hollow passageway inside helical-shaped lever 114 is in communication with the cavity 126 of the shaft 110 and the interior volume of the bottle. This provides a clear pathway for pressurized gas to reach the interior volume of the bottle.

Figure 2:
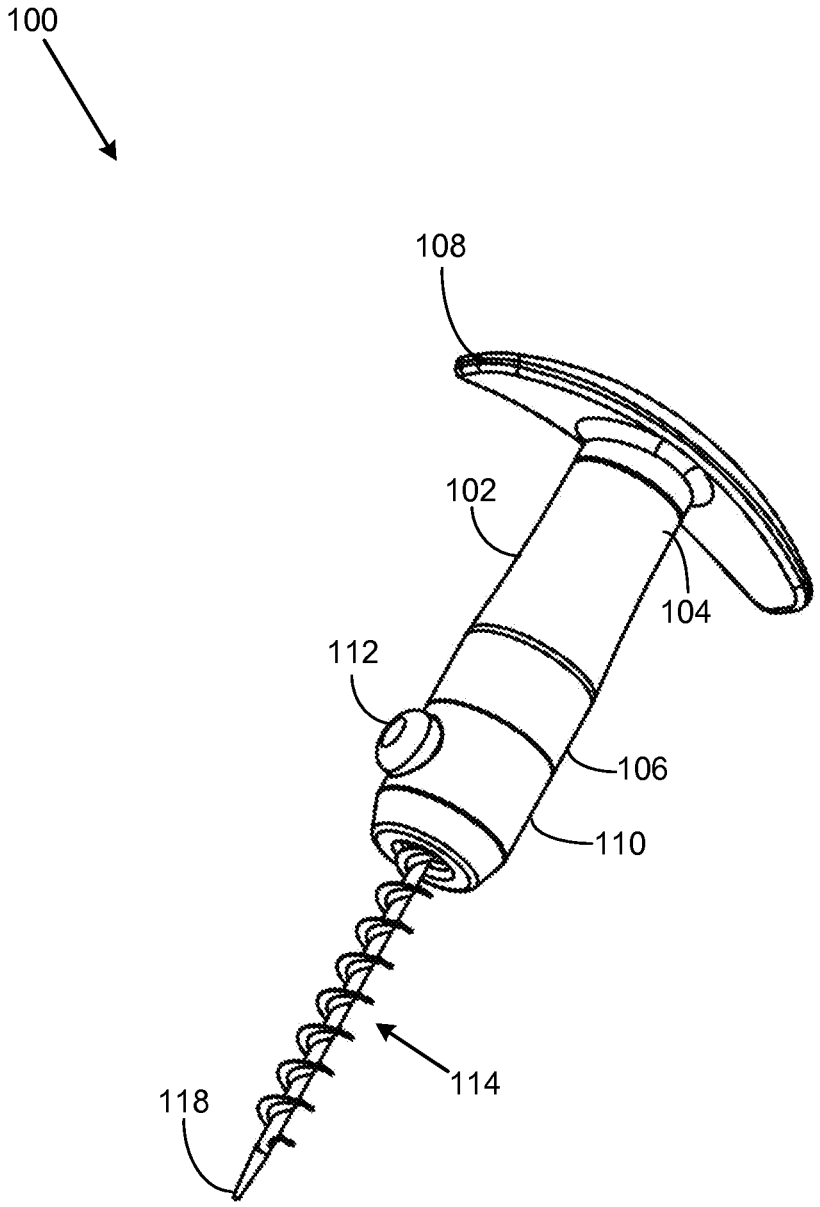
FIG. 2 is a front perspective view of a device for extracting a cork from a bottle with a pressure release button with a helical-shaped lever with a pointed end.

FIG. 2 is a front perspective view of device 100 for extracting a cork from a bottle with a pressure release button 112 and a hollow helical-shaped lever 114 with a pointed end 118. Working in conjunction with the helical-shaped lever 114, the device 100 further includes a gas cartridge 120 for containing and enabling manual release of a pressurized gas into the interior volume of the bottle. Gas cartridge 120 is threaded into a release valve mechanism 124 from within handle 108. In some embodiments, gas cartridge 120 may be prefabricated and constructed from a metal. Pressurized gas may include, without limitation, air, oxygen, nitrogen, and $CO_2$.

Release valve mechanism 124 operatively connects to gas cartridge 120 inside shaft 110. Release valve mechanism 124 regulates gas cartridge 120 to enable discharge of the pressurized gas. In one embodiment, gas cartridge 120 threadably engages release valve mechanism 124. In another embodiment, release valve mechanism 124 is a one-way annular valve.

A pressure release button 112 operatively connects to release valve mechanism 124. In one embodiment, pressure release button 112 is located on one side of release valve mechanism 124. Pressure release button 112 is configured to variably release the pressurized gas. The variable discharge helps prevent inappropriate cork tearing or fragmentation of a cork with adhered edges. Pressure release button may include, without limitation, a button, a switch, and a spring biased lever.

Figure 3:
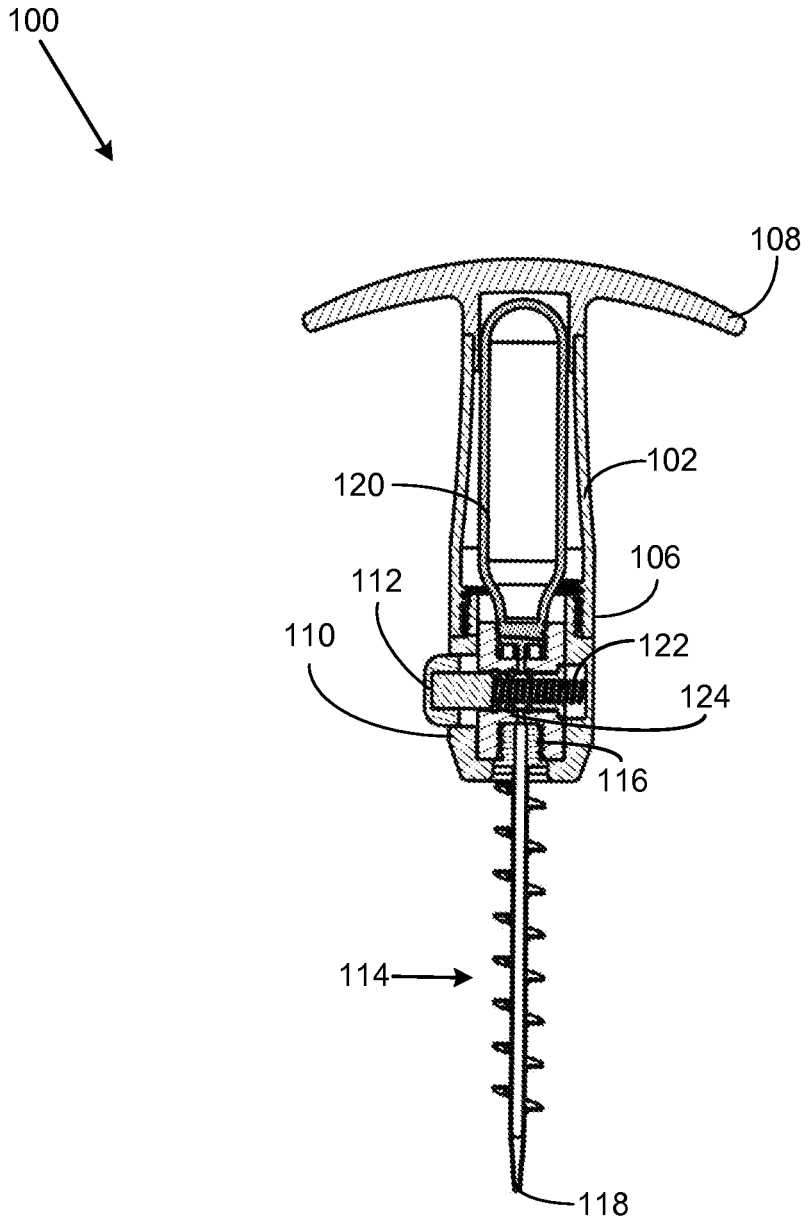
FIG. 3 is a cross-sectional view of a device for extracting a cork from a bottle with a helical-shaped lever with a pointed end taken generally along line 3-3 of FIG. 1.

FIG. 3 is a cross-sectional view of a device 100 for extracting cork from a bottle with a helical-shaped lever 114 having a pointed end 118 taken generally along line 3-3 of FIG. 1. In one possible embodiment, device 100 utilizes a spring 122 to provide tactile feedback to the pressure release button 112. Spring 122 is disposed across the length of the shaft 110. Spring 122 engages helical-shaped lever 114.

Pressure release button 112 senses when helical-shaped lever 114 has penetrated the cork through spring 122. Pressure release button 112 operatively connects to spring 122 at the release valve mechanism 124, so as to provide tactile feedback when the spring 122 expands. The moment at which helical-shaped lever 114 has fully penetrated the cork, helical-shaped lever 114 relaxes and spring 122 is consequently triggered. Specifically, penetration of helical-shaped lever 114 through the cork causes the spring 122 to expand in the shaft 110, and press against pressure release button 112. This engagement between spring 122 and pressure release button 112 provides a tactile indication for when the pressurized gas should be released into the bottle.

In one possible embodiment, device 100 utilizes a spring 122 that provides tactile feedback against pressure release button 112 when helical-shaped lever 114 has fully penetrated the cork. Spring 122 initially positions in a compacted position across the release valve mechanism 124. Spring 122 is contracted until helical-shaped lever 114 fully penetrates the cork. The moment at which the helical-shaped lever 114 has fully penetrated the cork, tension is removed from helical-shaped lever 114, thereby causing spring 122 to expand. Expansion of spring 122 works to abut spring 122 against pressure release button 112; thereby forming tactile feedback to a user.

Thus, as spring 122 is released from compressed position and expands, it presses against the pressure release button 112; thereby displacing pressure release button 112. This displacement creates tactile feedback that indicates the cork has been penetrated by the helical-shaped lever 114. Consequently, upon feeling tactile feedback, a user may manipulate pressure release button 112 to discharge the pressurized gas from gas cartridge 120. The tactile feedback helps synchronize penetration of the cork by the helical-shaped lever 114, with the discharge of pressurized gas, so as to optimize effectiveness of the device 100 when removing the cork.

As discussed above, the pressurized gas passes through the air exhausting hole 130 of shaft 110 and/or opening at pointed end 118 of helical-shaped lever 114, before finally filling the interior volume of the bottle. The variable discharge of the pressurized gas allows for controlled pressurization of the internal volume of the bottle; thereby preventing cork tearing or fragmentation. Thus, damage to the cork is minimized because the pressurized gas in the interior volume of the bottle forces the cork out of the bottle and the helical-shaped lever creates an axial and rotational force on the cork.

Figure 4:
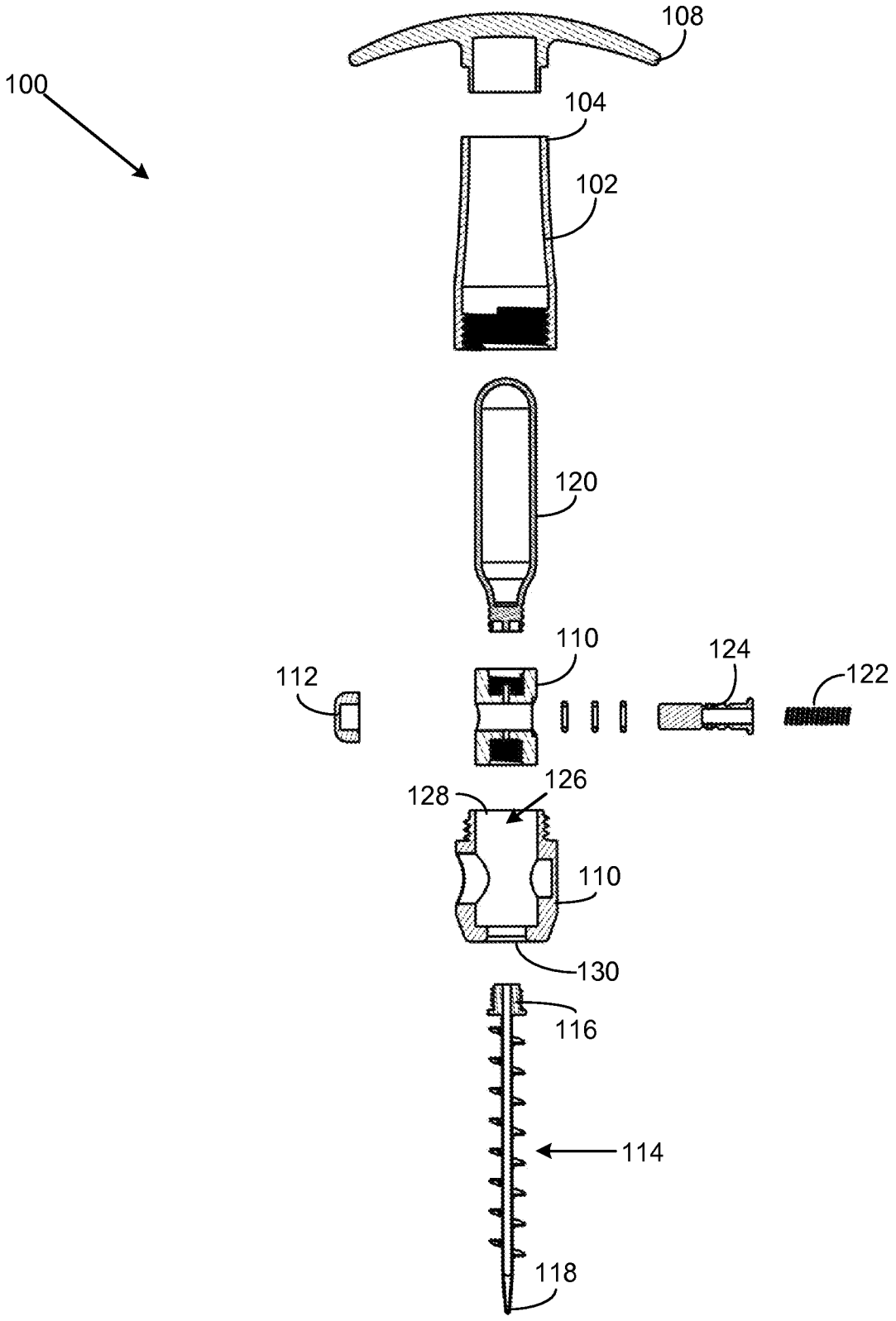
FIG. 4 is an exploded cross-sectional view of a device for extracting cork from a bottle.

FIG. 4 illustrates an exploded cross-sectional view of the helical-shaped lever 114 wrapped around a longitudinal shaft 110. In operation, the user grasps device 100 using handle 108. Handle 108 enable the user to exert axial and rotational force on the cork for removal. While grasping handle 108, the user, with the same hand is able to engage pressure release button 112. Pressure release button 112 is located on one side of release valve mechanism 124. The moment at which helical-shaped lever 114 has fully penetrated the cork, tension is removed from helical-shaped lever 114, thereby causing spring 122 to expand. Expansion of spring 122 works to abut spring 122 against pressure release button 112; thereby forming tactile feedback to a user.

Pressurized gas is released from gas cartridge 120 in a controlled manner by the user through variable manipulation of the pressure release button 112. User, with one hand, grasps handle 108 and pushes pressure release button 112 downward, causing air to flow through the cavity 126 of shaft 110, out of the air exhausting hole 130, through the hollow passageway of helical-shaped lever 114, and finally into the interior volume of the bottle. This serves to force the cork upwards and eventually out of the bottle.

Figure 5:
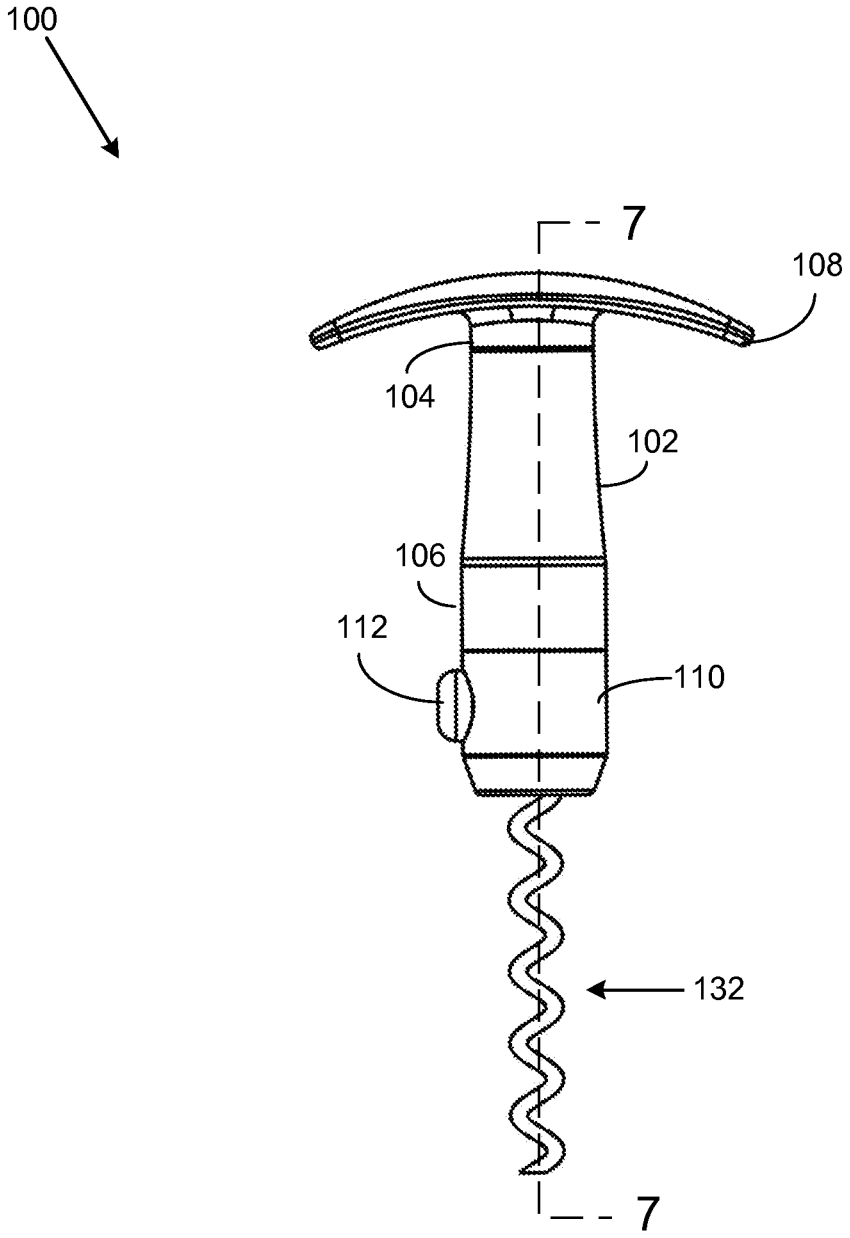
FIG. 5 is a side view of a device for extracting a cork from a bottle with a spiral-shaped lever in a corkscrew spiral shape.

FIG. 5 is a side view of a device 100 for extracting a cork from a bottle with a hollow shaft 110 bent in a spiral-shaped lever 132 having a generally spiral shape. In this embodiment, helical-shaped lever 114 follows a generally spiral shape, rather than the helical shape discussed above. Similar to the helical-shaped lever 114, spiral-shaped lever 132 utilizes a handle 108 to both screw the spiral-shaped lever 132 into the cork, and pull the cork out of the bottle. The spiral shape may include a corkscrew. The spiral shape may not utilize a linear rod around which the helix members pass around. The angle of the spiral members may vary depending on cork removing requirements.

Figure 6:
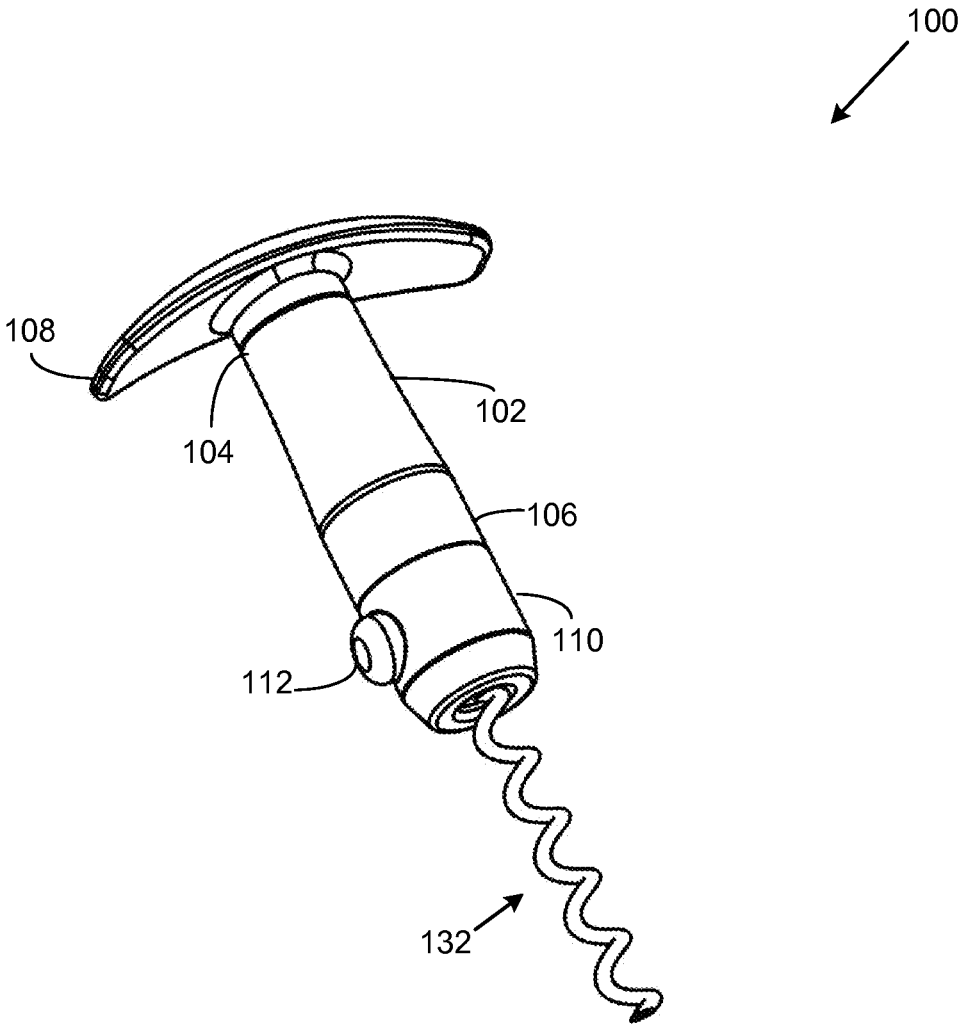
FIG. 6 is a front perspective view of a device for extracting a cork from a bottle with a pressure release button with a spiral-shaped lever in a corkscrew spiral shape.

FIG. 6 is a front perspective view of a device 100 for extracting a cork from a bottle with a pressure release button 112 with a hollow shaft 110 bent in a spiral-shaped lever 132. As with the helical-shaped lever 114, spiral-shaped lever 132 enables the user to encircle handle 108 with one hand, and while steadying the bottle with the other hand, the user may rotate handle 108, initially exerting a slight downward pressure to drive tip with sharp point into the cork. Spiral-shaped lever 132 protrudes through cork far enough so that channel forms through cork, enabling air exhausting hole 130 to be introduced into the neck of bottle gas.

Figure 7:
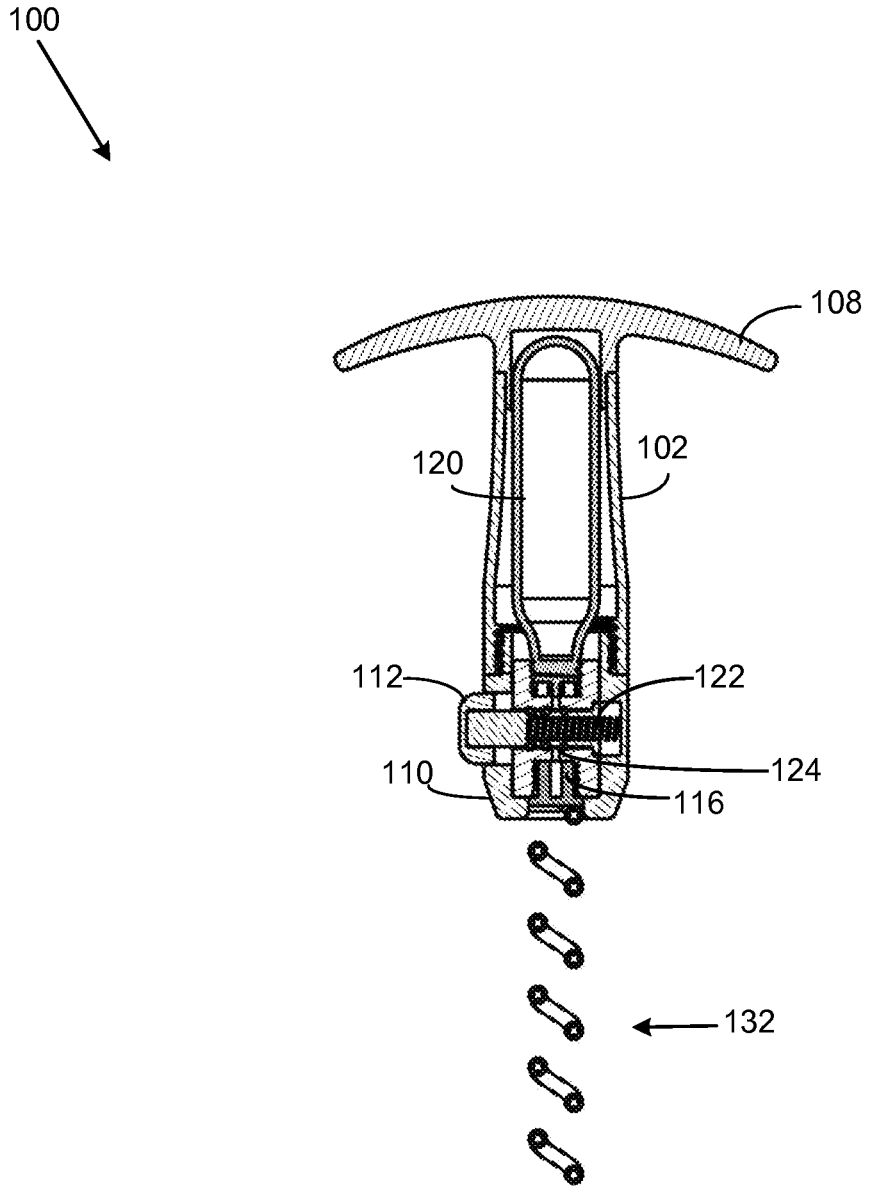
FIG. 7 is a cross-sectional view of a device for extracting a cork from a bottle with a hollow shaft bent helically in a spiral-shaped lever taken generally along line 7-7 of FIG. 5.

FIG. 7 is a cross-sectional view of a device 100 for extracting a cork from a bottle with a hollow shaft 110 bent helically in a spiral-shaped lever 132 taken generally along line 7-7 of FIG. 5. In some embodiments of spiral-shaped lever 132, release valve mechanism 124 receives and regulates gas cartridge 120 to enable discharge of the pressurized gas. Pressure release button 112 is configured to variably release the pressurized gas. The variable discharge helps prevent inappropriate cork tearing or fragmentation of a cork with adhered edges.

Figure 8:
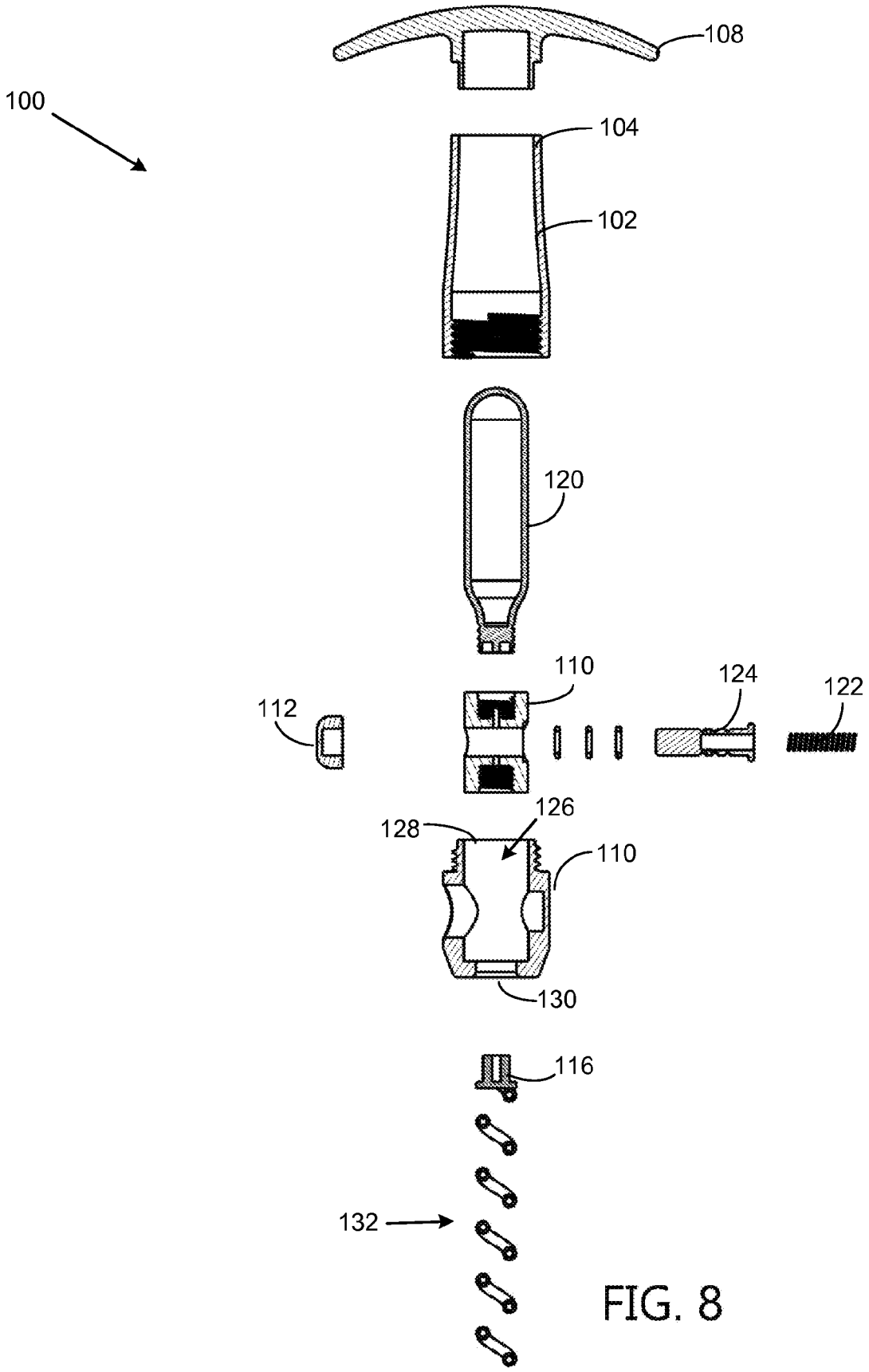
FIG. 8 is an exploded cross-sectional view of a device for extracting cork from a bottle with a spiral-shaped lever in a corkscrew spiral shape.

FIG. 8 is an exploded cross-sectional view of a device 100 for extracting cork from a bottle with a hollow shaft 110 bent helically in a spiral-shaped lever 132. In some embodiments of spiral-shaped lever 132, pressure release button 112 senses when the spiral-shaped lever 132 has penetrated the cork through a spring 122 that is disposed across the length of shaft 110. Pressure release button 112 operatively connects to spring 122 in the release valve mechanism 124, so as to provide tactile feedback when spring 122 expands.

The moment at which spiral-shaped lever 132 has fully penetrated the cork triggers spring 122. Specifically, penetration of the helical-shaped lever 114 through the cork causes spring 122 to expand in shaft 110, and against pressure release button 112. This provides a tactile indication for when the pressurized gas should be released into the bottle.

These and other advantages of the invention will be further understood and appreciated by those skilled in the art by reference to the following written specification, claims and appended drawings.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A device for extracting a cork from a bottle, the device comprising: a housing, the housing defined by an upper end and a lower end;

a shaft, the shaft defined by a cavity, an air intake, and an air exhausting hole, the shaft configured to operatively connect to the lower end of the housing;

a helix-shaped lever, the helix-shaped lever defined by a hollow passageway, a mount end, and a pointed end having an opening, the mount end of the helix-shaped lever configured to fixedly attach to the shaft, wherein the hollow passageway of the helix-shaped lever is in communication with the cavity of the shaft;

a handle, the handle configured to attach to the upper end of the housing, the handle further configured to enable axial and rotational manipulation of the helix-shaped lever; a gas cartridge, the gas cartridge configured to contain a pressurized gas; a release valve mechanism, the release valve mechanism configured to contain the gas cartridge, the release valve mechanism further configured to regulate discharge of the pressurized gas from the gas cartridge; and a pressure release button, the pressure release button configured to operatively connect to the release valve mechanism, the pressure release button further configured to actuate discharge of the pressurized gas from the gas cartridge, wherein the pressurized gas discharges from the gas cartridge and passes through the cavity of the shaft, the hollow passageway of the helix-shaped lever, and the opening in the pointed end of the helix-shaped lever.

2. The device of claim 1, wherein the housing has a generally tubular shape.

3. The device of claim 1, wherein the shaft has a threaded terminus.

4. The device of claim 1, wherein the air intake and the air exhausting hole is disposed to position at a distal centimeter of the shaft.

5. The device of claim 1, wherein the handle has a substantially T-shape.

6. The device of claim 1, wherein the housing couples to the handle and is sealed at a left end and a right end by end caps.

7. The device of claim 1, wherein the release valve mechanism is an annular one-way valve.

8. The device of claim 1, wherein the pressure release button is configured to variably discharge the pressurized gas from the gas cartridge.

9. The device of claim 1, wherein the gas cartridge is configured to be threaded into the release valve mechanism from within the handle.

10. The device of claim 1, wherein the gas cartridge is prefabricated.

11. The device of claim 1, wherein the device is configured to extract a cork from a bottle.

12. The device of claim 11, wherein the pointed end of the helix-shaped lever is configured to axially penetrate through the cork.

13. The device of claim 12, wherein the pressurized gas fills an interior volume of the bottle.

14. The device of claim 13, wherein the pressurized gas forcibly displaces the cork from the bottle.

15. The device of claim 14, wherein the pointed end of the helix-shaped lever is configured to axially penetrate the cork.

16. The device of claim 15, further including a spring, the spring configured to operatively connect to the pressure release button, the spring further configured to expand against the pressure release button when the helix-shaped lever penetrates the cork.

17. A device for extracting a cork from a bottle, the device comprising: a housing, the housing defined by an upper end and a lower end;

a shaft, the shaft defined by a cavity, an air intake, and an air exhausting hole, the shaft configured to operatively connect to the lower end of the housing;

a helix-shaped lever, the helix-shaped lever defined by a hollow passageway, a mount end, and a pointed end having an opening, the mount end of the helix-shaped lever configured to fixedly attach to the shaft, wherein the hollow passageway of the helix-shaped lever is in communication with the cavity of the shaft, the pointed end of the helix-shaped lever configured to penetrate a cork;

a handle, the handle configured to attach to the upper end of the housing, the handle further configured to enable axial and rotational manipulation of the helix-shaped lever; a gas cartridge, the gas cartridge configured to contain a pressurized gas; a release valve mechanism, the release valve mechanism configured to contain the gas cartridge, the release valve mechanism further configured to regulate discharge of the pressurized gas from the gas cartridge;

a spring, the spring configured to operatively connect to the pressure release button, the spring further configured to expand against the pressure release button when the helix-shaped lever penetrates the cork; and a pressure release button, the pressure release button configured to operatively connect to the release valve mechanism and the spring, the pressure release button further configured to actuate variable discharge of the pressurized gas from the gas cartridge, the pressure release button further configured to provide tactile feedback when the spring expands, wherein the pressurized gas discharges from the gas cartridge and passes through the cavity of the shaft, the hollow passageway of the helix-shaped lever, and the opening in the pointed end of the helix-shaped lever.

18. The device of claim 17, wherein the pressure release button is configured to variably discharge the pressurized gas from the gas cartridge.

19. A device for extracting a cork from a bottle, the device comprising: a housing, the housing defined by an upper end and a lower end;

a shaft, the shaft defined by a cavity, an air intake, and an air exhausting hole, the shaft configured to operatively connect to the lower end of the housing;

a spiral-shaped corkscrew, the spiral-shaped corkscrew defined by a hollow passageway, a mount end, and a pointed end having an opening, the mount end of the spiral-shaped corkscrew configured to fixedly attach to the shaft, wherein the hollow passageway of the spiral-shaped corkscrew is in communication with the cavity of the shaft;

a handle, the handle configured to attach to the upper end of the housing, the handle further configured to enable axial and rotational manipulation of the spiral-shaped corkscrew;

a gas cartridge, the gas cartridge configured to contain a pressurized gas; a release valve mechanism, the release valve mechanism configured to contain the gas cartridge, the release valve mechanism further configured to regulate discharge of the pressurized gas from the gas cartridge; and a pressure release button, the pressure release button configured to operatively connect to the release valve mechanism, the pressure release button further configured to actuate discharge of the pressurized gas from the gas cartridge, wherein the pressurized gas discharges from the gas cartridge and passes through the cavity of the shaft, the hollow passageway of the spiral-shaped corkscrew, and the opening in the pointed end of the spiral-shaped corkscrew.

20. The device of claim 19, further including a spring, the spring configured to operatively connect to the pressure release button, the spring further configured to expand against the pressure release button when the helix-shaped lever penetrates a cork.

* * * * *